United States Patent [19]

Fern

[11] Patent Number: 4,639,166

[45] Date of Patent: Jan. 27, 1987

[54] CONSTRUCTION OF JACKETS

[75] Inventor: Derek T. Fern, Watford, United Kingdom

[73] Assignee: PMB Systems Engineering Limited, London, England

[21] Appl. No.: 724,123

[22] Filed: Apr. 17, 1985

[30] Foreign Application Priority Data

Mar. 22, 1985 [GB] United Kingdom ..... 8507553

[51] Int. Cl.[4] ..... E02D 21/00; E02D 25/00

[52] U.S. Cl. ..... 405/203; 405/195; 29/429; 52/116

[58] Field of Search ..... 405/203, 204, 205, 195; 29/430, 429; 52/116, 119

[56] References Cited

U.S. PATENT DOCUMENTS

| | | | |
|---|---|---|---|
| Re. 29,413 | 9/1977 | Hekkanen et al. | 405/204 |
| 2,581,098 | 1/1952 | Guenzel | 405/204 |
| 3,228,151 | 1/1966 | Woolslayer et al. | 52/116 X |
| 3,517,516 | 6/1970 | Bea | 52/116 X |
| 4,018,057 | 4/1977 | Erzen et al. | 405/205 X |
| 4,080,916 | 3/1978 | Nastasic et al. | 405/205 X |
| 4,493,591 | 1/1985 | Francis | 405/205 X |
| 4,556,342 | 12/1985 | Tannahill | 405/203 |

*Primary Examiner*—Dennis L. Taylor

*Attorney, Agent, or Firm*—Townsend and Townsend

[57] ABSTRACT

A jacket of an offshore platform has a special internal structure of which one side coincides with one side of the jacket but an opposite side is spaced from the corresponding opposite outer side of the jacket. The jacket is made by a rolling-up process while lying recumbent, the special internal structure being made first and then being used to provide the reaction points for the rolling-up of outer-side-forming trusses of the jacket, which are of greater height, when erected, than the special internal structure and carry angle parts which are to form the said outer opposite outer side of the jacket.

22 Claims, 11 Drawing Figures

CONSTRUCTION OF JACKETS

This invention relates to the construction of jackets. The jacket is the structural part of an off-shore structure which extends from the seabed to the platform. They have major corner-posts extending from top to bottom of the jacket these being braced both along the sides and internally of the structure so as to render it rigid.

BACKGROUND OF THE INVENTION

These jackets may be of considerable length, 200 meters being now fairly commonplace. To achieve stability at such a length they are usually tapered from a wide base to a narrower apex. The base may be as much as 100 meters across.

Because of their enormous size and weight these jackets are usually built on their sides on a slipway leading to water, so that a launching barge can be brought up close to the place of building. Once built, they are slid lengthwise onto the barge and taken to where they are to be used. Except where stated otherwise, references in this specification to "height", "vertical", "length" etc all relate to the situation at the construction site, with the jacket lying on its side.

The slipways are much closer together than the width of the base of the jacket—otherwise they could not continue onto any reasonable barge. So a specific internal structure is provided in the jacket which primarily acts to support and sustain the jacket while it is lying on its side and supported only on the slipways. The portions of the jacket laterally to each side of this special structure hang right out beyond the support points on the slipway.

The conventional method of construction and assembly of all these parts is to prefabricate them while they are lying flat on the ground and then erect them into the vertical condition by means of cranes. This process is called rolling up. They are then held vertical while the relevant braces are fitted in order to hold them together in the final assembly. First, the two trusses (that is to say basically planar structures extending lengthwise along the jacket) constituting the special internal structure are built lying flat and are then rolled up together to form the internal rectangular structure. The trusses are sometimes known in this art as "bents".

Thereafter, the outer trusses which are to define the side walls of the jacket are similarly built flat and rolled up and secured to the internal structure by braces. Then, temporary supports on the ground which have held the outer trusses are removed and the completed structure is ready to be moved to the barge.

The difficulty is to lift during the rolling up structures of this very considerable size and (when vertical) height.

Typically, the problem has been that the jacket designer has been concerned primarily with the finished product, from the point of view of length, stiffness requirements and so forth and has been concerned secondarily with the problems of the constructor (fabricator) of such jackets. The limits have been reached of the conventional methods of constructing these objects and a totally different approach to their design is needed, one which will take account of the problems of assembly and construction just as much as the problems of eventually providing a jacket which when on site will work to a given specification.

SUMMARY OF THE INVENTION

This is what the present invention is concerned with. This invention will allow jackets to be constructed with existing equipment which are of a larger size than would have been possible with that equipment by known methods to make known structures of jacket; and also will allow the construction of jackets of the sort of size which is already conventional with the use of less elaborate and costly lifting tackle than has to be used at the moment.

The invention achieves this by using the special internal structure of a jacket (the structure which is to sustain the jacket on the launching slipway) for the erection about it of prefabricated side trusses of the jacket which are of a greater height (when erected vertically) than the special internal structure.

This special internal structure is preferably made in the conventional way, that is to say by having its side trusses prefabricated horizontally and then rolled up by conventional lifting equipment to form the rectangular section of the internal structure. Even if the finished jacket is to be of a size which is greater than any which heretofore could have been made, the internal structure may be of a size which can be handled in conventional rolling up by existing cranes.

This special internal structure has a height which is at least half that of the side trusses; there may be a substantially constant difference all along the jacket between the height of the special internal structure and that of the side trusses, at a given cross section of the jacket. This is because there will be mounted on top of the special internal structure as the jacket lies extended horizontally, work platforms equipped with conventional cranes able to work up to the height of the side trusses when erected. If, as is also preferred, the special internal structure is of constant width along the whole of its length (that length being not necessarily the whole of the length of the jacket) then these working platforms can travel along the top surface of the special internal structure during the construction of the jacket so as to be able to be available for work at any point along its length.

To roll up the outer trusses, we prefer to use a strand jacking system tied between reaction points on the special internal structure and the side trusses and which upon contraction rolls up the outer truss into its vertical position.

The outer truss as first constructed will have a three dimensional bracing system between its two corner posts which will form (1) a three-dimensional framing system to sustain the truss against buckling as it is raised into the vertical and (2) at least most of and preferably substantially all of the "roof" of the jacket, that is to say the side truss of the jacket which lies uppermost during construction and which joins the two corner posts which lie uppermost during construction. That is to say, the bringing up of the two side trusses during rolling up forms a "roof" over the special internal structure and any working platforms which are on it. Of course the word "roof" does not imply a necessarily continuous and weatherproof element; it rather serves to illustrate the closing over the top of the internal structure.

Furthermore, the bracing of the "roof" should be such as to provide free clearance and passage over the special internal structure and under the "roof", forming a path to allow the movement of working platforms along the upper side of the internal structure.

The general aim therefore is that the greatest amount possible of material shall be raised onto the jacket by rolling up the side trusses, so as to bring it to the highest possible points namely those to which it is most difficult to lift it by any other means and where it is most difficult to work upon it. This is done by the prefabrication of the side trusses. To lift these side trusses reaction points are provided on the special internal structure, from which extremely large and highly controllable tensile forces may be applied by means of strand jacks or similar contractive lifting devices, strong enough to lift these extremely heavy prefabricated parts.

The invention also includes therefore the method of constructing a jacket for an offshore platform which consists of first building a rectangular sectioned framework which will form a special internal structure of the jacket, and prefabricating in a generally horizontal plane side trusses of the finished structure, the width of the horizontal side trusses being greater than the vertical height of the special internal structure, rolling up the side trusses by pivoting them about longitudinal horizontal axes spaced from the respective sides of the special internal structure by applying a contractive lifting force between the top portion of the special internal structure and the side trusses and securing together parts of the side trusses which after rolling up overhang the special internal structure and are spaced from its upper surface. The method may additionally include the mounting of at least one working platform on the upper surface of the special internal structure with means for allowing it to move along that structure, and working from that working platform when making the final assembly of the upper portion of the rolled-up side trusses.

A particular embodiment of the invention will now be described with reference to the accompanying drawings wherein.

The embodiment to be described is an extremely large jacket having a length of approximately 1200 feet (approximately 370 meters) and a width at its base of approximately 400 feet (approximately 120 meters). With these dimensions, it is imperative to use the method according to the present invention if rollup types of construction methods are to be used. However the method according to the invention is, as indicated above, also useful for smaller sizes of jacket, those in which the weight and height of the side trusses do not exceed the lifting capacity of present cranes, since it will allow a much more efficient use of crane power in comparison with ordinary methods.

Figure 1:
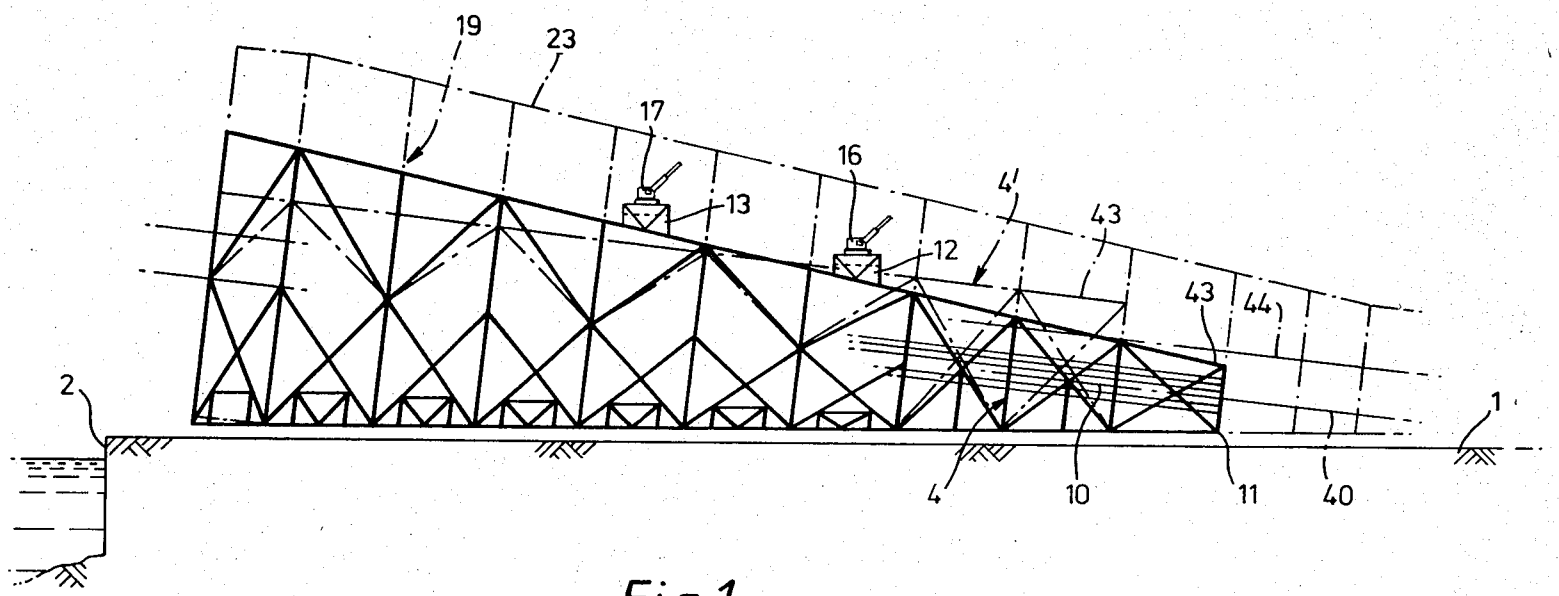
FIG. 1 is a side elevation of the jacket lying on the ground during construction.

In FIG. 1 a horizontal working base 1 leads to a quayside 2 to which a launching barge (not shown) can be brought flush. Slipways 3 (FIG. 2) are run along the working surface 1 parallel to each other and will be used to slide the assembled jacket from the surface 2 to the launching barge.

Above these slipways 3 is formed an internal structure 4 of the jacket. This has parallel side trusses 5,6 which are of conventional type for a jacket except that, as will be explained, they do not reach to the full height of the jacket as it lies on its side during construction.

Figure 2:
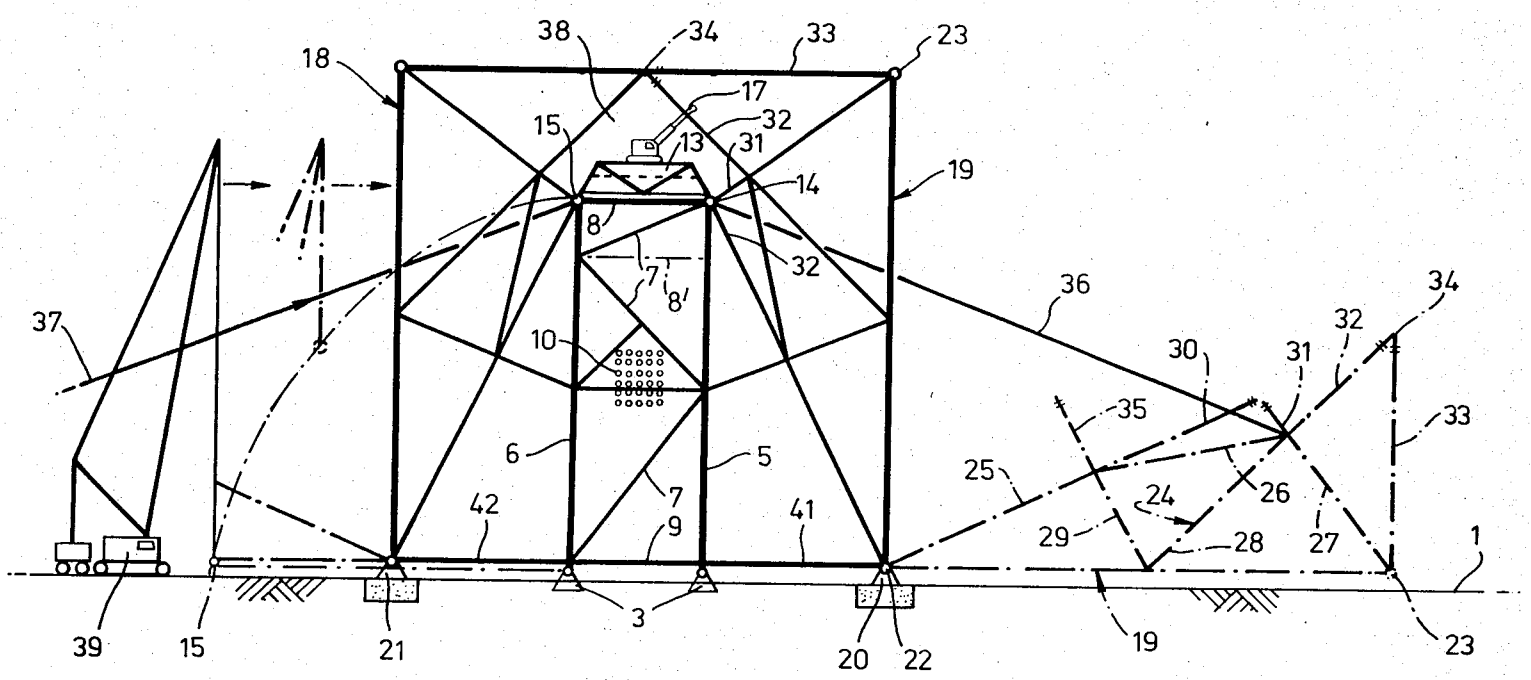
FIG. 2 is a typical cross section of jacket in that condition and showing steps in the rolling up of the various trusses.

These trusses 5 and 6 are formed in the conventional way flat on the surface 1 and are then rolled up about the pivot points defined on the slipways 3 into their vertical parallel condition by use of cranes 39 in a manner which is conventional and which is indicated in dotted lines on the left hand side of FIG. 2. Once erected they are permanently joined together by internal braces indicated generally at 7 and also by upper 8 and lower 9 crossbars to define a rectangular section internal structure. Furthermore, a conductor carrier framework 10 is provided within this structure at an appropriate position in relation to the dimensions of the finished jacket in a manner which will be explained.

In the example of embodiment being discussed the height of the side trusses 5 and 6 of the structure 4 is approximately 240 feet (approximately 73 meters) which is towards the limit of the lifting capacity of ordinary cranes used for rolling up in such construction. But the jacket when complete will have a width (height) dimension at its base which is fully 66% greater than that, and this will be done without using cranes of any greater size or of as yet unknown technology.

The internal structure 4 seen in side view (FIG. 1) is of the shape of a truncated triangle. In end view (cross section) it is of constant width. At its top (lowest when lying down) end 11 there will be raised onto it once it is constructed, one or more work platforms 12,13 which will run on slideways provided immediately above the top corner legs 14,15 of the side trusses of the internal structure 4. These working platforms will include sources of hydraulic and electric power and all other things needful for constructional operations, provide the base for cranes 16,17 and also be provided with, for example, messing facilities for men working on the platforms. It is to be remembered that at least when these platforms are towards the base of the internal structure (leftwards in FIG. 1) they will be at an elevation of some 82 meters above the ground.

Figure 11:
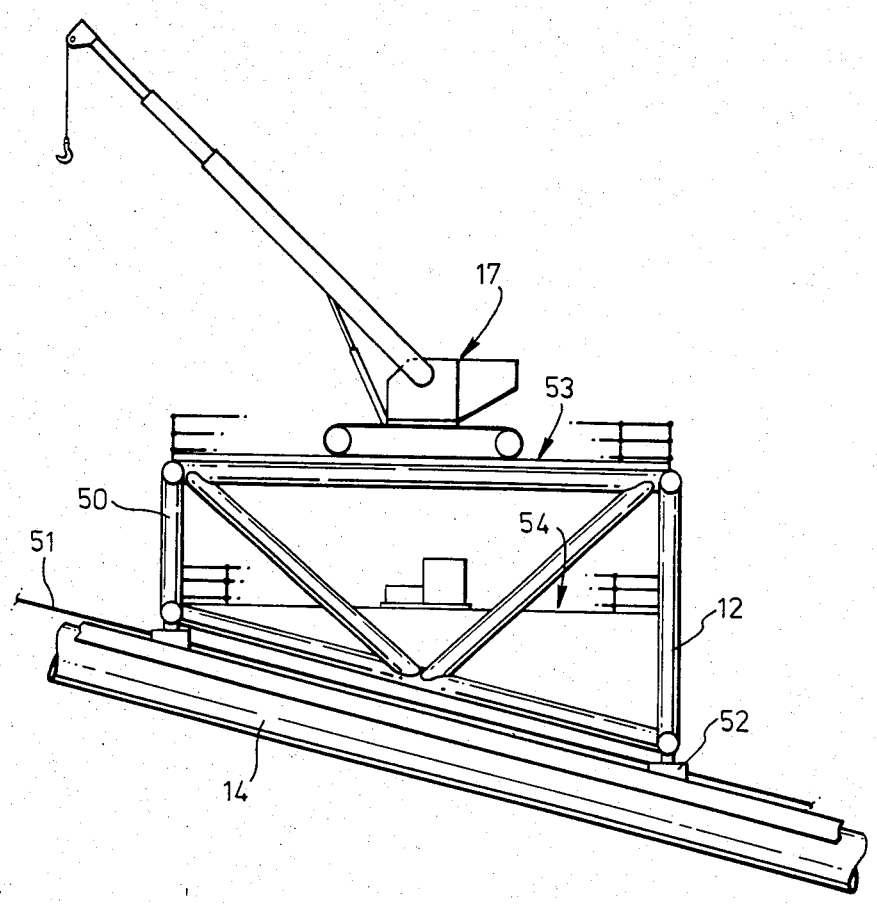
FIG. 11 is a side elevation of a working platform mounted on the internal structure.

In effect the working platforms 12 and 13 form girder bridges between the slideways provided above the corner posts 14,15 (FIG. 11).

At the position where the side trusses of the complete jacket will be found, temporary rollup cradle supports 20,21 are formed on the working surface 1. Side trusses 18,19 are built on the ground in a manner of building which is generally conventional. However the conformation of the side trusses is not conventional. On the upper surface of each truss as it is being formed, between its corner posts 22 and 23 a system of bracing 24 is erected. It includes a frame-forming assembly 25,26, 27,28,29 which will give rigidity to the side truss as it is rolled up pivoting about the cradle 20. It includes also however additional braces 30,31 which converge on points in space which in the assembled jacket are occupied by the upper corner post 14 of the special internal structure 4. It also includes braces 32 and side wall forming braces 33 which converge on points 34 which are at the centre line of the width of the finished jacket.

They converge upon these points but do not actually reach them because as will be explained, actual attachment at those points will be effected by connection tubulars.

A further brace 35 is directed towards the side truss 5 of the internal structure 4 opposite the convergence of the braces 7 and cross member which sustain the conductor frame 10.

At a strong point in this bracing system (which it is to be realised is shown two-dimensionally in FIG. 2 but extends also along the length of the truss i.e. into and out of the paper plane) there are attached at suitable intervals along the length of the side truss the cables of strand jacking systems 36. Strand jacking systems are known per se as being extremely strong easily controlled systems for contractile traction. When the structure is ready, the strand jacking systems are set in action along the length of the jacket and the side truss 19 is rolled up into its vertical position seen in full lines in FIG. 2 where the side wall forming brace 33 and its convergent brace 32 overhang the top of the special internal structure 4. The initial rotation (perhaps the first 20° of the rollings) may be assisted by crane lift.

The other side truss, 18, which has not been specifically described but is a mirror image of the truss 19 may be rolled up simultaneously, or a stay rope such as 37 may be proved to stabilise the internal structure 4 while trusses 18 and 19 are rolled up in turn.

Once both side trusses 18,19 have been rolled up so that their sides are vertical and their side braces 33 form a "roof" over the internal structure 4, the points of intersection 34 along the jacket are secured by welding of interfitting tubulars as are also the braces 31,32 secured to the top corner post 14 of the internal structure 4 and the brace 35 to the side truss of that internal structure. Such connections are made all along the jacket as appropriate.

These connections are made by workmen based upon the work platforms 12,13 who have their materials readily to hand and whose lifting equipment such as cranes 17 can handle with ease the comparatively small distances and comparatively small weights involved in such operations (for example the tubulars used for securing together the braces from different trusses may weigh as little as a couple of tons each).

It will be noted that the conformation of braces 31,32 with the overhang of side forming brace 33 is such that a clear passage or "tunnel" 38 is left all along above the upper face 8 of the special internal structure 4. This allows the working platforms 12,13 to travel the whole length of that upper face so as to reach any part of the trusses 18,19 which cannot be reached by conventional cranes from the surface 1.

There is a portion, 40 in FIG. 1, of the jacket where the internal structure 4 has been discontinued. But at this level where the width (height when recumbent) of the jacket is low and conventional cranes from surface 1 can easily handle the work associated with the securing together of the side trusses.

Also inserted will be bottom forming braces 41,42. When the structure is secure, the working platforms will be brought to the lowest point, 43 of the internal structure and dismantled and removed. Also dismantled and removed are the temporary rollup cradles 20,21 leaving the complete structure borne on the slipways 3 ready to be taken off after any further fitting out operations to the launching barge at the quay 2.

Figure 3:
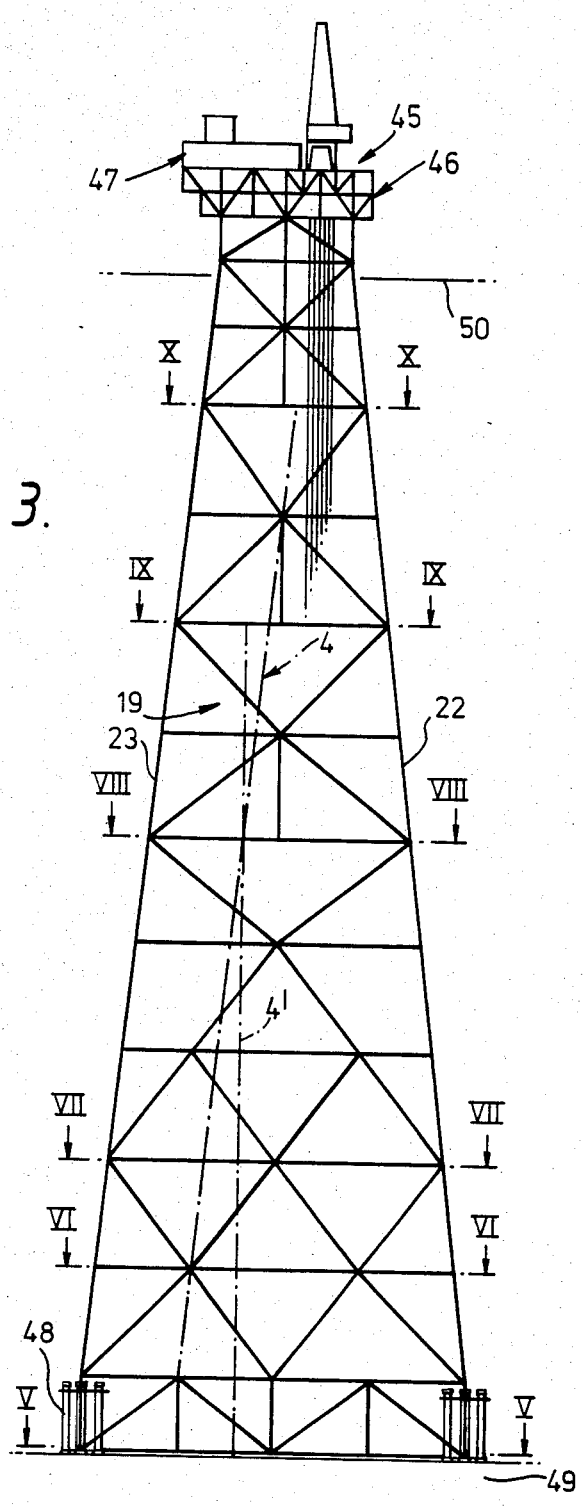
FIG. 3 is a side view of the jacket in position on the seabed and with a platform fitted.

The position of the conductor guides 10 in the internal structure 4 is arranged to be such that they are substantially parallel to one side of the relevant centre line 44 of the jacket. This is because, as is seen in FIG. 3, the working zone 45 of a platform 46 should be to one side of that platform with messing or residential areas 47 as far removed from it as possible (this being for maximum safety) while at the same time the conductors to be fitted to the conductor guides 10 should be straight or substantially so. In the side elevation seen in FIG. 3, the outline of the internal structure 4 is seen in dotted lines and we are looking at the face of the side truss 19.

At the foot of its corner legs 22,23 are seen the sleeves 48 which are for the piling which will secure the jacket to the seabed 49.

Figure 4:
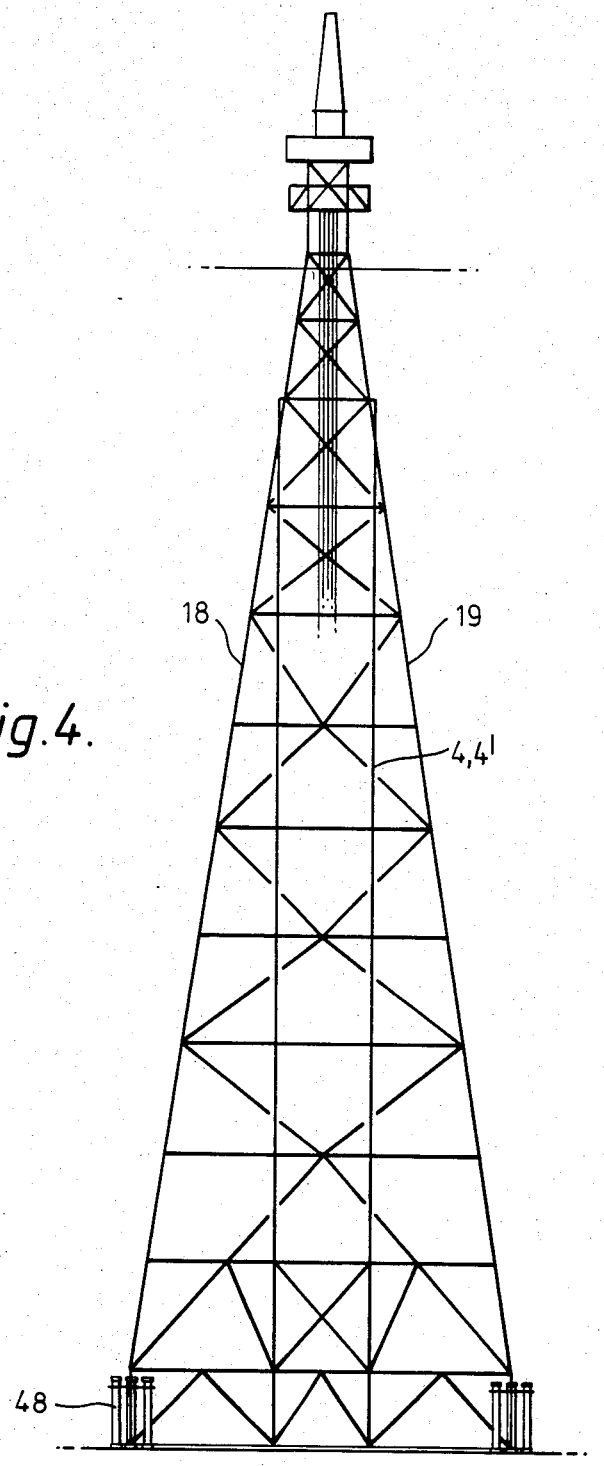
FIG. 4 is an elevation at right angles to FIG. 3.
Figure 5:
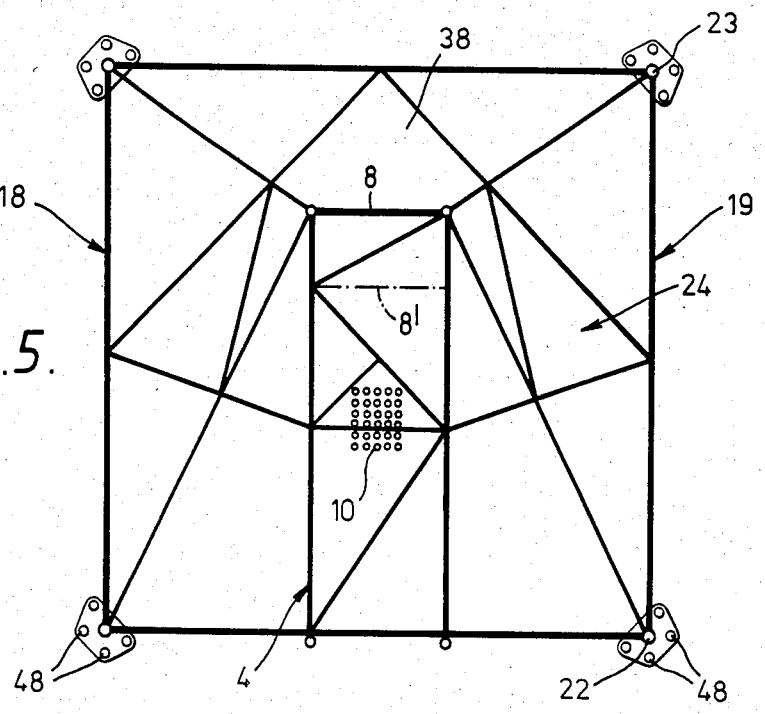
FIGS. 5,6,7,8,9 and 10 are cross sections through the finished jacket at various levels of its height.
Figure 6:
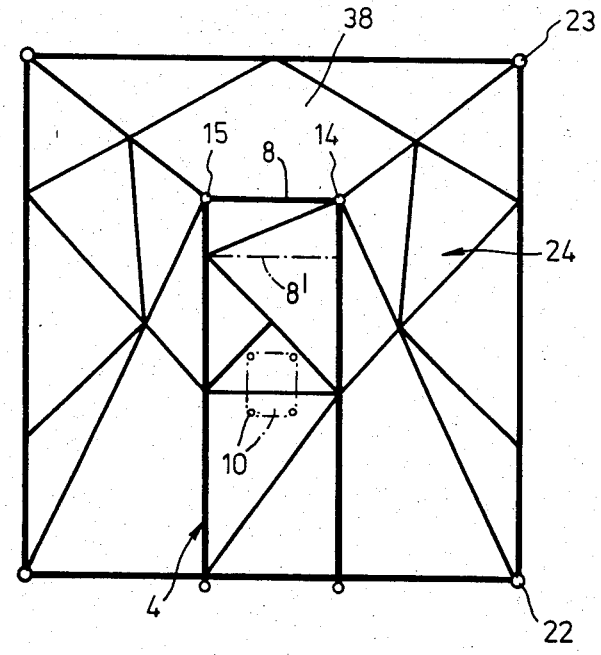
Figure 7:
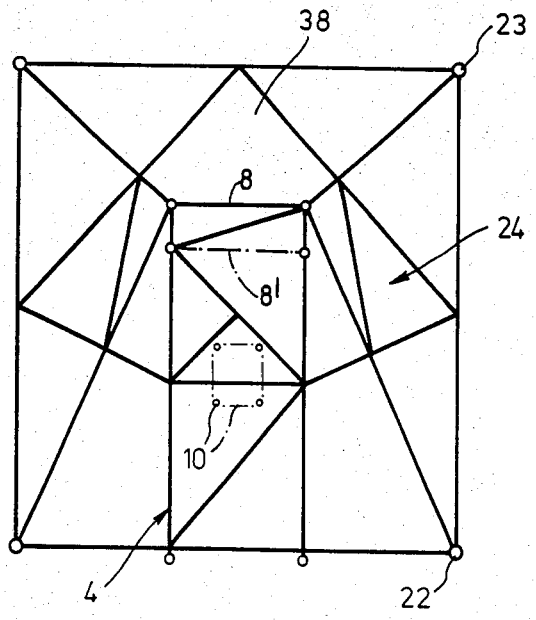
Figure 8:
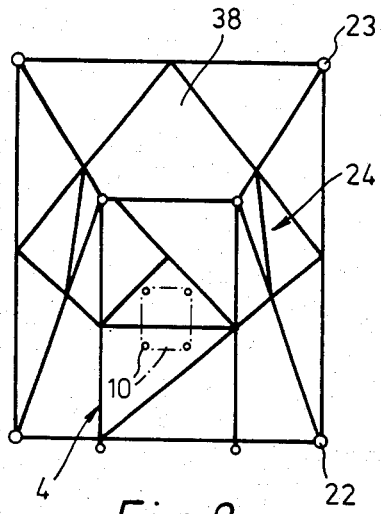
Figure 9:
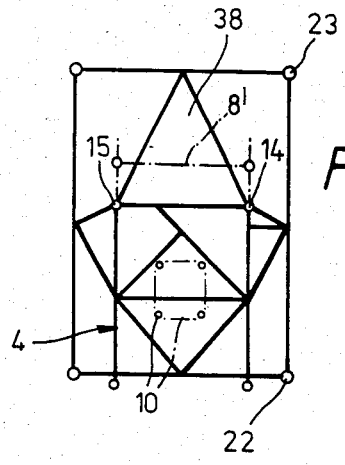
Figure 10:
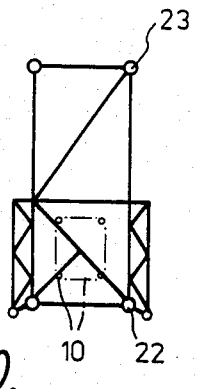

The elevation taken at right angles at FIG. 4 shows the strictly parallel conformation of the internal structure 4 in that view, and how it may extend even slightly beyond the strictly planar conformation of the side trusses 18,19 as these converge together.

FIGS. 5 to 10 show various representative cross sections of the jacket at various levels from the seabed 49 to just under sea surface level 50.

FIG. 11 shows in greater detail a working platform 12 adapted to slide lengthwise along the upper face 8 of the internal structure 4. The platform comprises essentially a framework 50 which can be drawn by strand-jacks on a cable 51 along the top corner legs 14,15 of the internal structure. The framework 50 is proportioned so as to provide a horizontal working deck 53, which conveniently accommodates a crane such as crane 17, while a lower deck 54 may provide workshop, storage and other facilities.

One alternative conformation of the special internal structure is shown in dotted lines at 4', FIGS. 1 and 3. Here, the upper side of the structure lies not generally parallel to the corresponding outer side truss of the jacket, as with structure 4, but parallel to the centre line 44 of the jacket. This enables use of smaller cranes for the rolling up of the internal structure 4' than are needed for the structure 4 and simplifies the bracing pattern in and around the conductor framework 10. The cross sections of FIGS. 5 to 9 show correspondingly the situation of a top cross bar 8' of a structure 4'.

Of course, other conformations are possible.

I claim:

1. A method of constructing an elongate jacket for erection in water as a supporting structure wherein said jacket is constructed with its axis of elongation lying generally horizontally, comprising the steps of forming elongate central trusses, said central trusses having elongate edges generally parallel to said axis of said jacket;

raising said central trusses into upright and mutually opposed positions resting on their respective elongate edges, and bracing said central trusses together to form a strong and coherent internal structure extending lengthwise of the jacket and having a base, upright sides and an upper surface;

prefabricating substantially horizontally at least one side truss having outer and inner elongate edges, said inner elongate edge extending alongside and outwardly laterally spaced from a corresponding side of said internal structure;

supporting said inner elongate edge of said side truss;

applying tensile force between said internal structure at positions spaced from its base and said side truss at positions spaced from said inner elongate edge, thereby to rotate said side truss into an upright position resting on said inner elongate edge; and bracing said side truss thus rolled up at least to said internal structure.

2. A method as claimed in claim 1, wherein the height in lateral cross-section of said side truss after rotation is greater than the height of said internal structure.

3. A method as claimed in claim 2, wherein said side truss has a substantially 3-dimensional and self-supporting structure including angled side portions, said side portions overhanging said internal structure after rolling up said side truss.

4. A method as claimed in claim 3 wherein there are first and second side trusses disposed respectively at the lateral sides of said internal structure, and said side portions of said first and second side trusses abut onto one another above said internal structure on rolling up said first and second side trusses, thereby forming an upper side of said jacket.

5. A method as claimed in claim 1 which includes using strand jacks to apply said tensile force between said internal structure and said side truss.

6. A method as claimed in claim 1 which includes bracing said side truss substantially from working platforms movable along said upper surface of said internal structure.

7. A method as claimed in claim 1 which includes using strand jacks to apply said tensile force between said internal structure and said side truss and bracing said side truss substantially from working platforms movable along said upper surface of said internal structure.

8. In a roll-up method of construction of an elongate jacket for an offshore structure wherein trusses are prefabricated while lying generally horizontally and are lifted to rotate about an axis of rotation along an elongate edge of the trusses to extend generally vertically, the improvement comprising:

forming an internal structure for trusses of a first height when erected;

using the internal structure to provide reaction for the lifting and rotation of at least one further truss, the further truss being of a second height when erected greater than the first height; and bracing the further truss to the internal structure so that the further truss and the internal structure form parts of the elongate jacket.

9. The improvement as claimed in claim 8 wherein the lifting rotation is by strand jack systems extending between the internal structure and the further truss.

10. The improvement as claimed in claim 8 wherein the further truss has at least at its elongate edge remote from that having the axis of rotation an angle structure extending generally vertically when the truss is generally horizontal and generally horizontally when the truss is generally vertical, the angle structure projecting to over the internal structure when the further truss is erected.

11. The improvement as claimed in claim 8 including mounting a working platform on a top edge of the internal structure and securing the further truss into the jacket by working from the working platform.

12. The improvement as claimed in claim 11 wherein the working platform is translatable longitudinally along the top edge.

13. The improvement as claimed in claim 11 wherein two further trusses are erected one on each lateral side of the internal structure, the further trusses having angle structures substantially meeting over the internal structure and leaving a free passage along the length of the internal structure above its top edge and below the angle structures.

14. The improvement as claimed in claim 8 wherein the further truss is prefabricated with a three-dimensional framing on its upper surface, the framing including at least one position substantially meeting a side of the internal structure upon erection of the further truss.

15. The improvement as claimed in claim 13 wherein each further truss is prefabricated with a three-dimensional framing on its upper surface, the framing including at least one position substantially meeting a side of the internal jacket structure upon erection of the further truss.

16. A jacket for erection in water as a supportng structure, comprising:

a base;

an apex;

a plurality of outer sides running from said base to said apex and defining in general a length and lengthwise direction of said jacket between said base and said apex, said plurality of outer sides comprising mutually opposed first and second outer sides and other outer sides; and a lengthwise elongate internal structure extending for at least part of the length of said jacket, said internal structure being of substantially rectangular cross section and having mutually opposed first and second sides and other sides, said first side of said internal structure being incorporated in said first outer side of said jacket, said second and other sides of said internal structure being spaced inwardly from and braced to respective second and other outer sides of said jacket over a substantial part of the length of said internal structure, such that said internal structure extends in lateral cross-section at least half way from said first outer side across to said second outer side.

17. A jacket as claimed in claim 16, wherein said second side of said internal structure is substantially parallel with said second outer side.

18. A jacket as claimed in claim 16, wherein said second side of said internal structure is substantially parallel with the median plane of the structure which is equidistant from said first and second outer sides.

19. A jacket as claimed in claim 16 wherein a conductor frame is mounted within said internal structure.

20. A jacket as claimed in claim 19 wherein said conductor frame extends parallel to the median plane of the jacket.

21. A method of building a jacket structure on a horizontal workplace surface comprising fabricating a first pair of trusses to lie generally horizontally, said trusses each having a leg along each elongate edge, said trusses being fabricated spaced apart with mutually closer legs being parallel and being supported on respective ones of parallel slipways, rolling up said trusses about respective axes of rotation defined by said parallel legs by lifting said trusses by cranes until the said trusses extend generally vertically, bracing said trusses together to form a generally rectangular-section internal structure of the jacket, forming temporary supports spaced to each lateral side of the slipways, fabricating outer trusses of the jacket to lie generally horizontally, each outer truss having a leg along each elongate edge, said outer trusses being fabricated with mutually closer legs supported on respective ones of the temporary supports, rolling up said outer trusses about axes of rotation defined by said mutually closer legs by applying tensile force from said internal structure to said outer trusses, to bring said outer trusses extending generally vertically, bracing said outer trusses to said internal structure and to each other to form the jacket structure including said internal structure, and removing the temporary supports to leave the jacket structure supported on the slipways.

22. A method as claimed in claim 21 wherein said outer trusses are fabricated to include a framing structure on an upper face thereof and, extending generally vertically from the mutually remoter elongate legs, an angle structure, the distance between the legs of the outer trusses being greater than the distance between the legs of the trusses of the first pair of trusses.

* * * * *